United States Patent [19]

Wieth et al.

[11] Patent Number: 4,635,782

[45] Date of Patent: Jan. 13, 1987

[54] SAFETY ARRANGEMENT

[76] Inventors: Franz Wieth, Schraystr. 28; Horst Sonnendorfer, Kirchenstr. 31, both of 8034 Germering, Fed. Rep. of Germany

[21] Appl. No.: 632,197

[22] Filed: Jul. 18, 1984

Related U.S. Application Data

[63] Continuation-in-part of Ser. No. 355,536, Mar. 8, 1982, abandoned.

[30] Foreign Application Priority Data

Jul. 23, 1981 [DE] Fed. Rep. of Germany ... 8121677[U]

[51] Int. Cl.[4] ..... G07F 1/06

[52] U.S. Cl. ..... 194/212; 194/905

[58] Field of Search ..... 194/4 R, 4 B, 4 D, 4 F, 194/4 G, 1 R

[56] References Cited

U.S. PATENT DOCUMENTS

| | | | |
|---|---|---|---|
| 3,165,189 | 1/1965 | Easterday | 194/4 F |
| 3,837,455 | 9/1974 | Hurt | 194/4 R |
| 3,897,863 | 8/1975 | Peggs | 194/4 R |
| 4,377,227 | 3/1983 | Sanford | 194/4 R |

FOREIGN PATENT DOCUMENTS

| | | | |
|---|---|---|---|
| 70997 | 2/1983 | European Pat. Off. | 194/4 R |
| 2900367 | 7/1979 | Fed. Rep. of Germany | 194/4 R |

*Primary Examiner*—Joseph J. Rolla
*Assistant Examiner*—Michael S. Huppert
*Attorney, Agent, or Firm*—Collard, Roe & Galgano

[57] ABSTRACT

A safety device for connecting orderly positioned shopping carts to each other includes a token extractor comprising a control key device which is insertably-releasable from the shopping cart and carries an insert having a token-receiving slot. An encoding ring is positioned on the upper surface of the grip of the cart. A releasing member is resiliently suspended on the cart and serves for connecting one cart to a neighboring cart when the releasing member of one cart is inserted into the encoding ring of the neighboring shopping cart. The releasing element is provided with coding markings and can be inserted into the encoding ring of the neighboring shopping cart in a plurality of various positions corresponding to the markings on the releasing element whereby the shopping carts of one supermarket can be distinguished from the shopping carts of another supermarket located at the same shopping plaza.

11 Claims, 4 Drawing Figures

SAFETY ARRANGEMENT

CROSS-REFERENCE TO RELATED APPLICATION

This application is a continuation-in-part of the application Ser. No. 355,536 filed Mar. 8, 1982, now abandoned.

BACKGROUND OF THE INVENTION

The present invention relates to security devices for connecting various carriages to each other. More particularly the invention relates to a security arrangement for orderly positioned shopping carts which should be returned by customers to a cart-collecting station.

Security arrangements of the type under consideration may be required at drugstores, supermarkets, or farmer markets where customers normally leave the used and no more needed carts at car parking areas. The problem is that shoppers do not return used shopping carts either to the entrance of the store or to a special borrow area. The carts left near parked cars in the parking areas become obstacles for the moving cars. These randomly left shopping carts can be idle for a relatively long period of time; this is undesirable since due to growing needs the number of shopping carts prepared for use at the entrance of the store is not sufficient.

In order to avoid unnecessary work and to minimize personal costs available carts are normally placed near the entrance of the store in a so-called borrow area and positioned in series or rows in an insertable-one-into-another position, and then are firmly connected to each other.

It has been suggested that in order to separate the last cart from the row of merchandise carts a customer should drop a coin into a coin evaluator or extractor positioned on the body of the cart whereby the rigid connection between two adjacent carts becomes released and the last cart in a row will be available for use. When a customer brings the cart back to a predetermined place and puts this cart into a position in a row of carts he can get his coin back.

German patent publication No. 2900367 describes a shopping trolley provided with a fastening device and a coin or note operated lock. Insertion of money releases a single shopping trolley from a fastening device. The money is refunded when the trolley is returned to a fastening device. The system comprises fixed coupling elements, and each trolley has a coin or note operated lock which can be locked onto a fastening device in a locking area.

Alternatively each trolley may be locked to the automatic lock of another trolley, provided the other trolley is locked to a fastening device or to a further trolley. When the money is inserted, only the last trolley is released, and the money is refunded when the trolley is returned and locked to a fastening device or to the lock of another fastened trolley.

A storage for stackable trolleys provided with coin-freed mechanisms is disclosed in U.S. Pat. No. 4,377,227.

Systems for return of merchandise carts have been also disclosed in U.S. Pat. Nos. 3,165,189; 3,837,455 and 3,897,863. None of the known systems, however, has suggested means allowing to avoid mess and confusion between the shopping carts of neighboring supermarkets and stores located at the same plaza.

SUMMARY OF THE INVENTION

It is an object of the invention to provide an improved safety arrangement for shopping carts.

Another object of the invention is to provide a coded arrangement which is easy and convenient to use for a shopper.

Still another object of the invention is to provide a safety device for a shopping cart which assists in returning lended carts back to the borrow area and placing them in orderly position.

A still further object of the invention is to avoid mess and confusions which may occur in the stores when carts are randomly placed around the store.

These and other objects of the invention are attained by an arrangement for securing orderly positioned shopping carts to each other, comprising a token extractor having a housing positioned on the shopping cart and including a control key element adapted to receive tokens therein and slidably insertable into said housing; an encoding ring adjustably mounted on the shopping cart; a releasing member suspended on the shopping cart and having a position ring adjustably mounted thereon, the releasing member of one cart being insertable into the encoding ring of the neighboring shopping cart to thus reliably connect said one cart to the neighboring one; and means in said housing to lock said releasing member in said housing after it is inserted into the encoding ring of the neighboring cart and to simultaneously release said control key element from said housing and to permit a return of a token to a customer, said means releasing said releasing member from said housing once said control key element with a token inserted therein is pushed into said housing, said releasing member carrying coding means for defining various adjustable positions of said releasing member relative to the encoding ring into which the releasing member is to be inserted.

The control key element may be provided with an interchangeable insert having a slot for receiving coins.

The position ring may be formed with a longitudinal projection extending outwardly from a free end thereof. The projection may have an S-shaped cross-section.

The encoding ring may have an interior diameter, said position ring having an exterior diameter, said interior diameter corresponding to said exterior diameter.

The encoding ring may include two diametrally positioned projections formed on an interior surface thereof, the position ring being provided with two diametrally positioned recesses, said recesses receiving said projections when said releasing member is inserted into the encoding ring.

The releasing member may have an underside projecting outwardly of the position ring and provided with a number of insertion markings, the insertion markings being uniformly angularly spaced from each other, the position ring may be adjusted on the releasing element in accordance with one of the insertion markings.

The projection may have an elongated opening at the end portion thereof.

Due to the provision of the safety device with a control key arrangement having a token-receiving slot, which arrangement is slidably insertable into the shopping cart, only one coin or token is required to release the last cart from the row and it is very easy and convenient to manipulate the device.

The inserts carrying the token-receiving slots may be at any time replaced so that the same token evaluator may be utilized even if the fee goes up and various coins or tokens should be used.

In order to avoid mess and confusion between neighboring stores or markets it is suggested herein to use an encoding ring so that the token evaluators used in a certain store can be coded in a very simple manner and thus distinguished from those used by the owners of neighboring stores.

Such confusion and mess between the neighboring markets can be totally prevented by coding in different modes of encoding rings on the token evaluators and correspondingly adjusting the position rings of the releasing members.

It should be further noted that the provision of the S-shaped projection on the releasing member and producing of the oblong opening at the end of this projection makes the insertion of the releasing member into the encoding ring very special since a latch may be locked or unlocked through this opening.

At the same time such construction protects the devices against illegal usage by very simple auxiliary means, such as bolt tighteners, for unlocking the latch in order to take a deposit without returning a previously lended cart to the store.

The aforementioned locking and releasing means may include a first elongated pin cooperating with said control key element to slidably displace the latter, a first spring biasing said elongated pin against said control key element, a second pin transverse to said first elongated pin, a second spring biasing, said second pin, the longitudinal projection of said releasing member, upon the insertion of the latter into the encoding ring and said housing, displacing said second pin against the action of said second spring while said first spring urges said first pin into engagement with said elongated opening.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figures 1, 2:
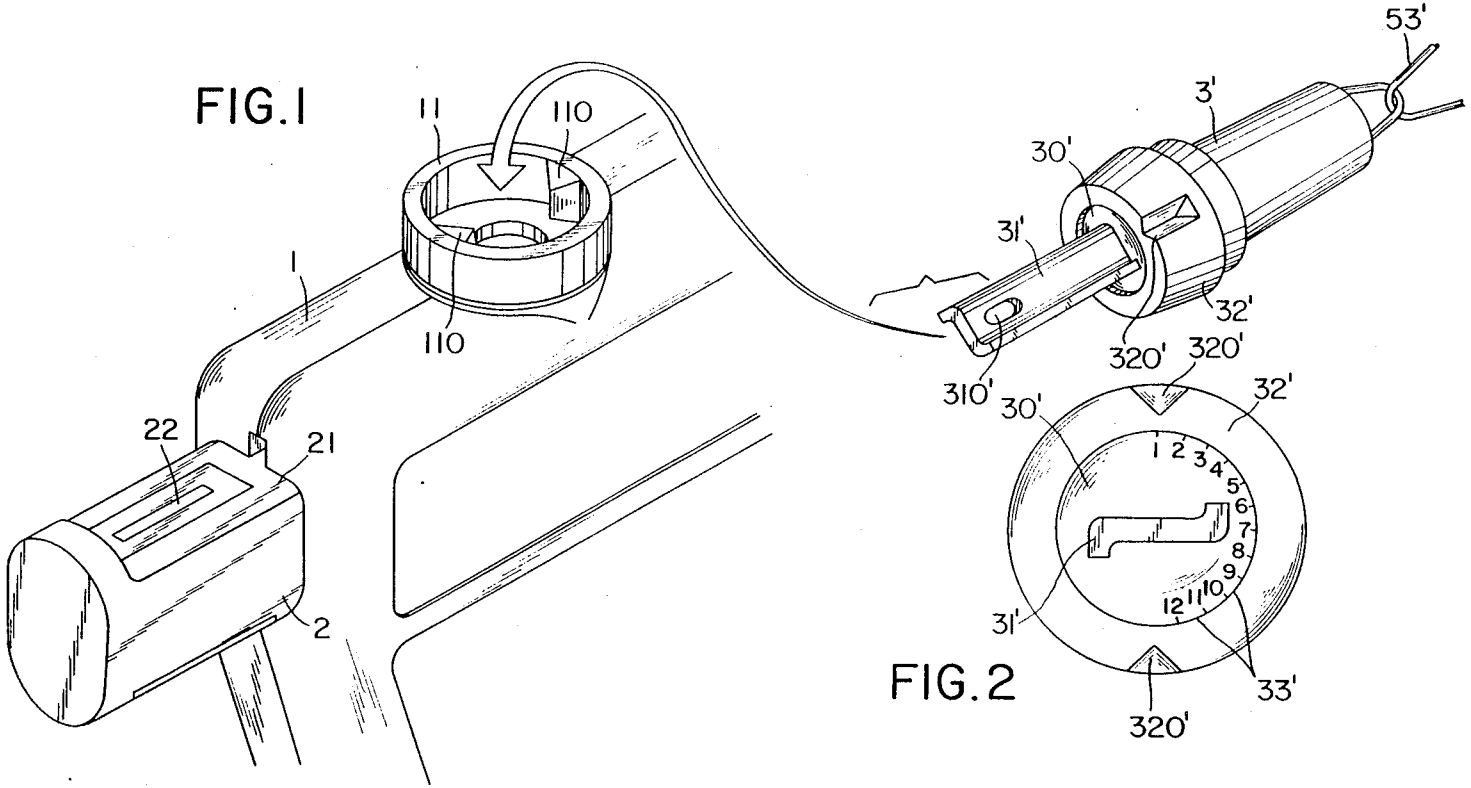
FIG. 1 is a partial perspective view of a safety device according to the invention, with a cart-releasing element of a neighboring shopping cart removed from a receiving ring of the safety arrangement.
FIG. 2 is an enlarged schematic front view of the cart-releasing element shown in FIG. 1.

FIG. 1 illustrates a partial perspective view of a safety arrangement provided on a shopping cart and a perspective view of the cart-releasing element insertable in the safety arrangement as will be described below. The safety arrangement includes a token-evaluator or extractor 1 mounted at any suitable location on the shopping cart, preferably on its grip as shown in the drawing. The remaining portion of the shopping cart for the sake of convenience is not illustrated herein. At the left side of the token-extractor a control key device 2 is located. The control key device includes an interchangeable token-insert 21 formed with a slot 22 for receiving tokens or coins. On the upper surface of the token-evaluator 1 an adjustable encoding ring 11 is provided, which is mounted on a cylindrical projection 17 formed on the grip. Ring 11 can be turnably adjusted on the grip as can be seen from FIG. 3 and rigidly secured thereto after the adjustment as will be explained in detail below. The cylindrical ring 11 at the interior thereof is formed with two inwardly extending projections 110 which are positioned diametrally opposite each other.

Spaced from the grip of the shopping cart there is shown an engageably-detachable releasing element 3' of another shopping cart, which releasing element is to be inserted into encoding ring 11 as shown by an arrow. The cart-releasing element which belongs to the shopping cart shown in FIG. 1 is not illustrated in FIG. 1. However, as readily seen from FIGS. 3 and 4 this cart-releasing element is suspended on a chain 53, two links of which are illustrated. Chain 53' is also partially shown in FIG. 1 for the cart-releasing element 3'. A belt or any other suitable flexible connecting element can be provided for the cart-releasing element of each shopping cart. Cart-releasing element 3', which is suspended on a non-illustrated safety arrangement of the neighboring shopping cart, must be inserted into the encoding ring 11 of the safety device of the cart which is positioned in front of the cart to which releasing element 3' belongs, when the control key device 2 is in the position shown in FIG. 1.

Cart releasing element 3' has an adjustable and rigidly mountable thereon adjustment or position ring 32' which can be individually manufactured and applied onto element 3'. Two diametrally opposing recesses or cuts 320' are provided in the outer periphery of position ring 32'. The outer diameter of position ring 32' corresponds to the inner diameter of encoding ring 11 while recesses 320' complement the projections 110 which pass into those recesses upon insertion of cart-releasing element 3' into the encoding ring of the previously positioned shopping cart, whereby the releasing element 3' will be held in position in ring 11.

A longitudinal inserting projection 31' is provided at the free end of the releasing element 3'. This projection has an S-shaped cross-section and is formed at the end portion thereof with an elongated opening 310'.

As seen in FIG. 2 the bottom side 30' of the releasing element 3' is provided with a plurality, for example twelve, of uniformly angularly spaced apart insertion markings 33'. This means that the position ring 32' can be mounted on releasing elements 3' in twelve different positions. In other words, position ring 32' can be adjusted to releasing element 3' in any one of twelve positions whereby the safety device according to the invention can be coded in twelve various positions. Then position ring 32' with the inserting projection 31' rigidly connected thereto is inserted with an end thereof into the releasing element 3' in one selected position so that the recesses 320' of the position ring 32' remain in a predetermined position.

It is to be understood that encoding ring 11 provided on the token-extractor 1 is adjusted and mounted on the housing of the token-extractor in a corresponding position so that inserting projection 31' and position ring 32' with recesses 320' could be inserted into the encoding ring 11 in one predetermined position. Owing to the possibility of various adjustments of the encoding ring 11 and position ring 32' on the token-extractor it can be easily defined which shopping cart belongs to a certain supermarket in the same area, and a possible interchange of shopping carts as well as confusion between the neighboring supermarkets would be prevented.

Figure 3:
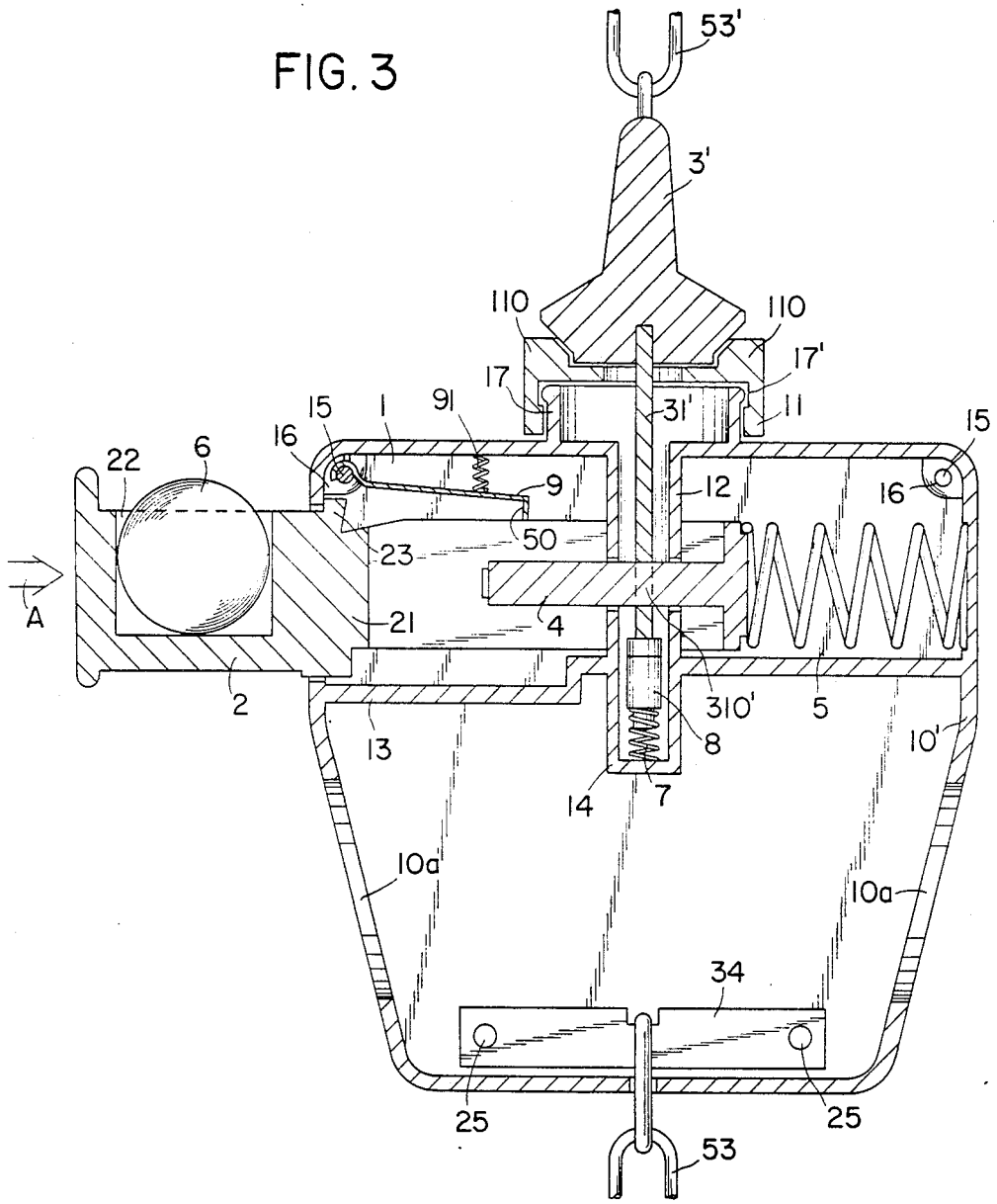
FIG. 3 is a side sectional view of the safety device of the invention with the cart-releasing element of the neighboring shopping cart in the inserted position.
Figure 4:
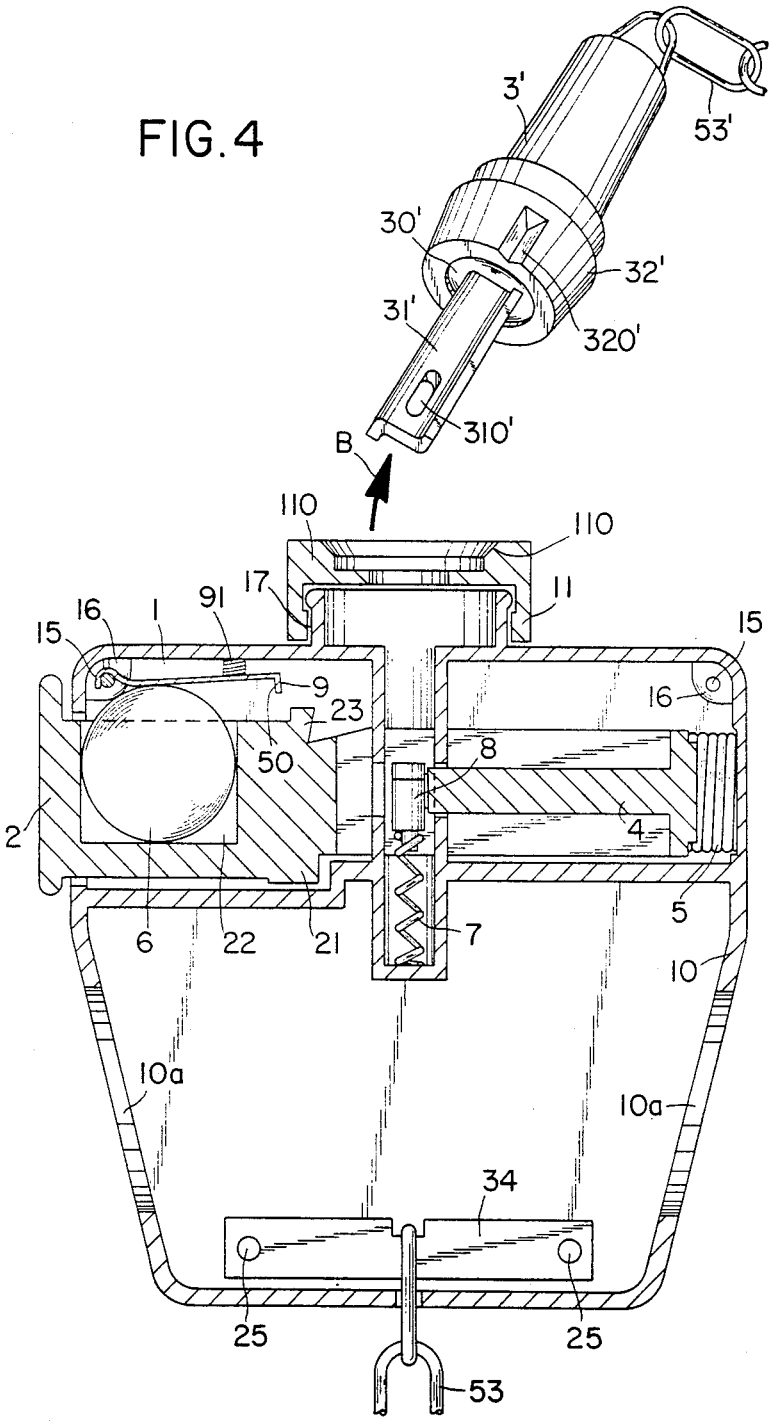
FIG. 4 is a side sectional view of the safety device according to the invention, but with the cart-releasing element of the neighboring cart in the disconnected position.

With reference to FIGS. 3 and 4 it can be seen, that the token-extractor 1 includes a housing 10. Guide 12 for guiding S-shaped inserting projection 31' is provided in housing 10. Guide 12 is formed in the exemplified embodiment by the extension projected inwardly of housing 10. The housing 10 is further provided with a lateral guide 13 into which the key device 2 is insertable from outside. Guide 12 is further extended into the interior of housing 10 so as to form a chamber 14, in which a spring 7 and a pin 8 biased by said spring are positioned. The function of pin 8 and spring 7 will be described hereinafter.

Openings 15 are formed in abutments 16 provided in housing 10 at the upper wall thereof. Screw bolts provided with respective nuts are received in these openings 15 so as to connect two halves of the token-extractor to each other. Two links of the chain 53 are illustrated at the bottom of FIG. 3. The end of the non-illustrated cart-releasing element similar to that shown in FIG. 1 is suspended on the chain 53. A holder plate 34 for holding chain 53 on the housing 10 is provided in the housing 10. Non-illustrated screw bolts insertable into openings 25 and extended between the two halves of housing 10 secure plate 34 in housing 10. A cylindrical projection 17 extended upwardly from the upper wall of housing 10 is provided in the housing. Projection 17 has a radially extended ring 17' while encoding ring 11 has a complementary annular recess whereby encoding ring 11 can be locked behind rim 17' in a selected position, corresponding to the selected position of adjustment ring 32' of cart-releasing element 3', in a form-locking manner.

At the end of key device 2, facing away from insert 21, is provided an elongated pin 4 which projects towards the insert 21. A projection 23 is formed on insert 21 of the key device 2, which projection abuts against the inner surface of the lateral wall of housing 10 in the extracted position of control key device 2. A hook-shaped latch 9 is mounted in housing 10 above projection 23. Latch 9, is pivotally held on the non-illustrated screw bolt inserted into the opening 15 formed in the left-hand abutment 16 of housing 10. Latch 9 in the extracted position of control device 2 shown in FIG. 3 receives the end of a spring 91 which is supported at its other end against the upper wall of housing 10. The above mentioned pin 8 biased by spring 7 positioned in chamber 14 receives in the extracted position of key device 2 the lower end of projection 31' of cart-releasing element 31. Pin 8 is pressed against projection 31' in this position by spring 7. Another spring 5 extended radially in housing 10 has one end supported against the right-hand lateral wall of housing 10 and another end supported against the end surface of pin 4. Spring 5 acts onto pin 4 to hold the control key device 2 in the extracted position shown in FIG. 3. For guiding and securing spring 5 small abutments can be provided on the inner surface of the right-hand lateral wall of the housing and on the right-hand end of key device 2.

Semicircular recesses **10*a* are formed in the bottom part of housing 10. The respective portions of the grip or handle of the shopping cart, to which the token extractor 1 is applied, are inserted into recesses 10*a*. In order to adjust to the smaller sizes of the shopping carts specific semicircular shells could be inserted into recesses 10*a*, the outer dimension of which would correspond to the dimension of each recess 10*a* while their inner dimension would correspond to the dimension of the respective grip of a smaller shopping cart to which the token extractor is to be applied. A token or coin 6 is insertable into slot 22 provided in the control key device 2**.

The cart-releasing element 3' seen in FIG. 3 is the element of the token extractor of the non-illustrated adjacent shopping cart. Cart-releasing element 3' is inserted and held in encoding ring 11 in the extracted position of key device 2. Holding of the cart-releasing element 3' in the token-extractor 1 is obtained by pin 4 which extends into the interior of key device 2 through the elongated opening 310' formed in the projection 31' of the cart-releasing element 3'. Thereby cart-releasing element 3' is locked in its inserted position in the token extractor 1 and can not be released from the token extractor without inserting a token or coin 6 into slot 22 of the key device 2. If a key device 2 without a coin is pushed in the direction of arrow A projection 23 comes into contact with the downwardly projected end extension 50 of latch 9 whereby no further sliding of the key device 2 into the housing 10 of the token extractor would be possible since latch 9 would prevent such further sliding. At the same time the length of pin 4 projected into the interior of key device 4 is so selected that this pin extends into elongated opening 310' of the cart-releasing element 3' only when projection 23 of the control device 2 abuts against end extension 50 of latch 9. This means that when a wrong coin or token 6 is inserted in slot 22 of control device 2 cart-releasing element 3' of the adjacent shopping cart can not be released and pulled out from the token extractor 1 so that the shopping cart, which a customer wished to disconnect from the cart with the inserted element 3', remains attached to that previous cart in the row of orderly arranged shopping carts.

When a coin or token of the size corresponding to that of slot 22 is inserted into control device 2 and the latter is pushed in the direction of arrow A into the token extractor 1 the upper end of the inserted coin will act on the lever portion of the latch 9 to displace the latter upwardly so that end extension 50 of latch 9 would not come into contact with projection 23 and would not prevent further sliding of control device 2 into the interior of token extractor 1. Upon a further insertion of control device 2 into housing 10 pin 4 projected in the control device 2 will be pushed out from opening 310' of the cart-releasing element 3'. Then this releasing element will be pressed upwardly by spring 7 and pin 8 and will be easily pulled out from the token extractor 1 by a customer in the direction of arrow B as shown in FIG. 4. Since now there is no connection between the shopping cart, into the token extractor of which a coin was inserted, and the neighboring following shopping cart in the row of the orderly positioned carts this cart can be removed from the row and used. At the same time spring 7 pushes pin 8 upwardly causing control device 2 to be held in the inserted position shown in FIG. 4, because the displacement of control device 2 in the leftward direction, or outwardly from token extractor 1, is prevented by pin 8 which at this time abuts against the end face of pin 4 and holds the latter against displacement. It is understandable that chain 53 with the releasing element 3 assigned thereto can not be lost.

If a customer does not need a shopping cart any longer he must bring this cart back into the supermarket and place it in a supply or collecting station. This cart then must be inserted into the last shopping cart in the row of orderly positioned carts, and the releasing element 3' which is connected to that last one shopping cart in the row should be inserted into the encoding ring of the cart placed into the collecting station by the shopper. If it is possible the elongated projection 31' of releasing element 3' will push pin 8 against the action of spring 7 downwardly unless the control device biased by spring 5 will be displaced in the leftward direction so that pin 4 extended into the interior of control device 4 will engage in elongated opening 310' of projection 31'. The control device 2 will be then displaced in the leftward direction unless projection 23 will strike against the inner surface of the lateral wall of housing 10. In this position the coin or token previously inserted into the control device 2 is accessible and can be easily removed from the insert 21.

It should be emphasized that due to various positions of the encoding ring 11 and position ring 32' in the token evaluator 1 it is easy to find out which shopping carts belong to a certain one of the neighboring stores or markets. Such an arrangement totally prevents mess and confusions which may occur in such neighboring supermarkets or drugstores which use similar shopping carts. When the shopping carts are positioned in a row their releasing elements are merely inserted and locked in encoding rings of corresponding token evaluators of the rearly positioned carts.

In order to separate the last one shopping cart from a series of inserted one into another carts a consumer simply drops a coin or a token into the slot 22 of the key device 2 of the last cart in the row and then forces the control key device 2 into the token extractor 1. The releasing element 3 of the cart positioned before the last cart in the row becomes thus unlocked and can be easily pulled out from the encoding ring 11 of the last shopping cart. The last cart in the row becomes released from the remaining carts and can be easily removed therefrom and used.

It will be understood that each of the elements described above, or two or more together, may also find a useful application in other types of safety devices differing from the types described above.

While the invention has been illustrated and described as embodied in a safety device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for securing orderly positioned shopping carts to each other, comprising a token extractor having a housing positioned on the shopping cart and including a control key element adapted to receive tokens therein and slidably insertable into said housing; an encoding ring adjustably mounted on the shopping cart; a releasing member suspended on the shopping cart and having a position ring adjustably mounted thereon, the releasing member of one cart being insertable into the encoding ring of the neighboring shopping cart to thus reliably connect said one cart to the neighboring one; and means in said housing to lock said releasing member in said housing after it has bean inserted into the encoding ring of the neighboring cart and to simultaneously release said control key element from said housing and to permit a return of a token to a customer, said means also releasing said releasing member from said housing once said control key element with a token inserted therein is pushed into said housing, said releasing member carrying coding means for defining various adjustable positions of said releasing member relative to the encoding ring into which the releasing member is to be inserted.

2. The arrangement as defined in claim 1, said position ring being formed with a longitudinal projection extending outwardly from a free end thereof.

3. The arrangement as defined in claim 2, wherein said projection has a cross section of an S-shape configuration.

4. The arrangement as defined in claim 1, wherein said control key element is provided with an interchangeable insert having a slot for receiving coins.

5. The arrangement as defined in claim 3, said encoding ring having an interior diameter, said position ring having an exterior diameter, said interior diameter corresponding to said exterior diameter.

6. The arrangement as defined in claim 5, said encoding ring including two diametrally oppositely positioned projections formed on an interior surface thereof, said position ring being provided with two diametrally oppositely positioned recesses on an outer surface thereof, said recesses receiving said projections when said releasing member is inserted into said encoding ring.

7. The arrangement as defined in claim 6, said releasing member having an underside positioned inside said position ring and provided with a number of insertion markings, said markings forming said coding means.

8. The arrangement as defined in claim 7, said insertion markings being uniformly angularly spaced from each other, said position ring being adjustable on said releasing member in accordance with one of said markings.

9. The arrangement as defined in claim 8, wherein said longitudinal projection has an end portion formed with an opening.

10. The arrangement as defined in claim 9, wherein said opening is elongated.

11. The arrangement in claim 9, wherein said means include a first elongated pin cooperating with said control key element to slidably displace the latter, a first spring biasing said elongated pin against said control key element, a second pin transverse to said first elongated pin, a second spring biasing said second pin, the longitudinal projection of said releasing member, upon the insertion of the latter into the encoding ring and said housing, displacing said second pin against the action of said second spring while said first spring urges said first pin into engagement with said elongated opening.

* * * * *